United States Patent [19]

Reynaud

[11] 4,449,492

[45] May 22, 1984

[54] ATTACHMENT FOR A HEAT SHIELD

[75] Inventor: Jean-Paul Reynaud, St. Georges d'Esperanche, France

[73] Assignee: Renault Vehicules Industries, Lyon, France

[21] Appl. No.: 396,445

[22] Filed: Jul. 8, 1982

[30] Foreign Application Priority Data

Jul. 10, 1981 [FR] France ..... 81 13612

[51] Int. Cl.[3] ..... F02F 1/26

[52] U.S. Cl. ..... 123/193 CH; 123/193 H; 123/188 S

[58] Field of Search ..... 123/193 H, 193 CH, 41.85, 123/188 S, 669; 92/169; 277/187, 117

[56] References Cited

U.S. PATENT DOCUMENTS 3,115,127 12/1963 Spencer ..... 123/41.85

3,125,082 3/1964 Stansfield ..... 123/193 CH 3,436,085 4/1969 Polk ..... 123/193 CH 4,290,396 9/1981 Urlaub ..... 123/193 CH

*Primary Examiner*—Ronald H. Lazarus

*Attorney, Agent, or Firm*—Oblon, Fisher, Spivak, McClelland & Maier

[57] ABSTRACT

An attachment for a heat shield is intended to protect the face of the cylinder head comprising one of the walls of the combustion chamber of the cylinder of an internal combustion engine in which the transfer of gases is controlled by valves having seats inserted into the cylinder head. The inserted seats of the valves are provided with an annular rim which, when the seat is fitted into a bore in the cylinder head, presses against the wall of the cylinder head the heat shield. Application is to insulating the inner walls of a heat engine cylinder head or to creating hot points in the combustion chamber of the cylinder head.

3 Claims, 1 Drawing Figure

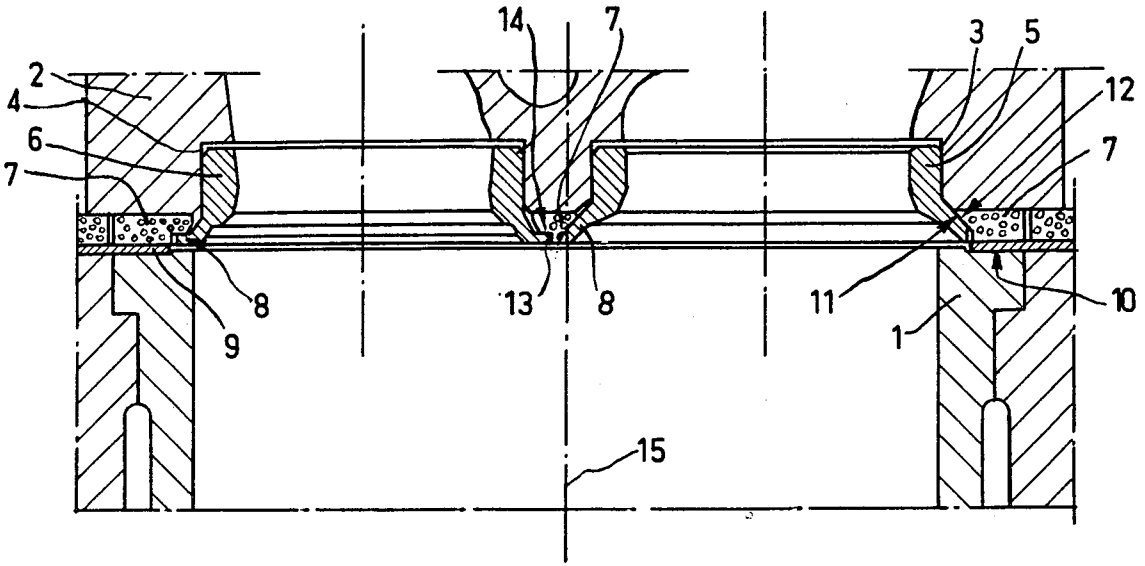
12
7
5
3
10
1
11
7
14
8
13
15
8
9
2
4
6
7

ATTACHMENT FOR A HEAT SHIELD

BACKGROUND OF THE INVENTION

1. Field of the Invention

The present invention relates to an attachment for a heat shield, in particular one usable with the cylinder head of an internal combustion engine equipped with a valve to control the transfer of gases in the engine's combustion chamber.

2. Description of the Prior Art

In known types of combustion engines, the combustion chambers are defined in general by the inner walls of a cylinder, by the face of a piston moving in the cylinder under the combined effect of the pressure of the gases in the combustion chamber and the inertia of the piston's mechanical drive structure, and by the inner walls of a cylinder head closing the cylinder, the cylindrical head often constituting the hottest part of the combustion chamber's jacket.

Rotary combustion engines have a combustion chamber delimited by the outer surface of a rotary piston and by the walls of a cylinder head enveloping the rotary piston. In such rotary engines, combustion of the gaseous fuel mixture always occurs in the same area, with no gaseous cooling by the cool fuel gases taken into the combustion chamber.

In order to limit the wear and tear caused by superheating of the walls of the combustion chamber and, especially in diesel engines, in order to benefit from the effect of distillation and vaporization of the liquid fuel by superheated walls, it has already been proposed that some of the walls of the combustion chamber of thermal engines be covered by a heat shield to protect the wall's metal from superheating. In addition, because of its relative thermal insulation properties, the heat shield is locally superheated to vaporize and ignite the liquid fuel injected into the combustion chamber.

The most frequently used materials for these heat shields are ceramics consisting for example of zirconium oxides, silicon carbides or nitrides prepared by sintering after hot or cold pressing. Other materials used for these heat shields are refractory materials and/or alloys that are poor conductors and that have good resistance to thermal shocks so as to withstand superheating over a large surface that is uncovered with each combustion cycle.

Attaching these shields is difficult by reason both of their coefficient of expansion, which is often different from that of the material in the element to be protected, and because of the significant temperature gradients present in the combustion chamber. The anchorings usually provided for these attachments do not take into account the relative variations in sizes between the shield and the element, which generally results in cracking followed by destruction of the shield or the element to be protected. In addition, these anchorings must be sufficiently close together, as the shields have relatively thin walls and have a tendency to vibrate, which causes further mechanical stress.

SUMMARY OF THE INVENTION

One of the objects of the present invention is to alleviate these defects of, and demands on, heat shields for combustion engines. To this end, the attachment for a heat shield intended to protect the face of the cylinder head, which comprises one of the walls of the combustion chamber of the cylinder of an internal combustion engine in which the transfer of gases is controlled by valves with seats inserted in the cylinder head. At least one of the inserted valve seats is equipped with an annular peripheral rim which, when the seat is fitted into its bore in the cylinder head, pushes the heat shield against the cylinder head wall. The heat shield is furthermore gripped between the cylinder head and the cylinder sleeve by means of the cylinder head joint interposed between the cylinders and the cylinder head. By this relatively simple and economical means, the shield consisting of a thin, flexible plate is grasped at relatively narrow areas of the intake and exhaust valves, making it possible to suppress or reduce the vibrations that might occur at certain engine rotation speeds corresponding to exciting frequencies for vibration of a flexible plate. In addition, precision in attaching the plate and its centering remain relatively simple, corresponding to the precision in attachment of the valve seats in the cylinder head. The plate constituting the shield can perfectly fit the shape of the combustion chamber walls while maintaining the possibility of expanding in relation to the valve seats and the edge of the cylinder sleeve.

According to another embodiment of the invention, the contact between the annular rim of the valve seat and the shield is achieved by means of at least one pair of conical, matched surfaces, arranged respectively on the rim of the seat and on the shield so as to assure centering of the shield on the seat and correction of any play existing between the seat and the shield.

Modern internal combustion engines have at least one intake valve and one exhaust valve which, in diesel engines especially, are often aligned at the center of the cylinder and along the general axis of the engine. The two detachable valve seats thus attach the shield along a line of attachment allowing for shield expansion on either side. When the cylinder head is mounted on the engine block of the engine cylinders, the heat shield is held in position by the detachable valve seats and presses against the cylinder head joint.

In the most practical embodiment of the invention, a separate heat shield is provided for each engine cylinder and is positioned between the cylinder head and the sleeve of each cylinder.

BRIEF DESCRIPTION OF THE DRAWING

Other purposes, advantages and characteristics of the invention will appear from the following description of one embodiment of the invention described with reference to the attached drawing in which the sole FIGURE shows a cross-section, with eliminated sections strictly limiting the view to this part, of the combustion chamber of the cylinder of a diesel-type internal combustion engine equipped with a heat shield attached according to the invention before installation of the valves.

DETAILED DESCRIPTION OF THE PREFERRED EMBODIMENT

The combustion chamber shown in the FIGURE, and corresponding to the cylinder of an internal combustion engine, is defined by the sleeve 1 of the cylinder, by the movable piston (not shown) inside of this cylinder, and by the cylinder head 2 of the engine. Intake and exhaust valve seats 5 and 6 are respectively set in bores 3 and 4 of the head 2 by rigid couplings. A heat shield 7 consisting of a thin plate of a suitable material, such as a refractory and/or relatively heat-insulating ceramic, is attached according to the invention by resting on an annular peripheral rim 8 of the valve seats 5 and 6. The rim 8 presses the shield 7 against the relatively planar walls of the parts of the combustion chamber delimited by the cylinder head 2. In order to complete the attachment of the shield 7, the cylinder head gasket 9 interposed between the cylinder head 2 and the upper face 10 of the sleeve 1 elastically grips the edges of the heat shield. The link between the body of the seat of the valves 5 and 6 and the rim 8 includes a conical surface 11 which cooperates with a matched conical surface 12 provided on the bore of the shield 7 traversed by the valve seat, to properly center the shield 7 on the corresponding valve seat 5 or 6 and tighten up the inevitable play existing between the bore of the shield 7 and the outer surface of the valve seat traversing this bore.

It can further be seen that the shield 7 has a recess 13 in which is housed the rim 8, and the annular bottom wall 14 of which serves as a stop for the corresponding valve seat 5 or 6.

In the arrangement shown in the FIGURE, the intake and exhaust valves are aligned transversally along an axis line passing through the longitudinal axis 15 of the cylinder and through the general axis of the line of the engine's cylinders. The shield covers a small surface of the wall of the cylinder head in the central axial part thereof, which is in fact covered by the cylinder valves. In contrast, larger surfaces of the cylinder head are covered by the shield 7 beyond this axial part of the cylinder head appearing in the FIGURE'S sectional plane.

The mounting of the heat shield 7 is achieved in the following manner: the shield 7 is put in position in the cylinder head before the fitting of the valve seats 5 and 6 in their corresponding bores 3 and 4. The valve seats 5 and 6 are then forcefully fitted into their bore to press against the shield 7 by their rim 8 and centering the shield by their conical surfaces 11. When the shield and the valve seats have been mounted, it is then possible to fully equip the cylinder head 2, in particular by installing the valves and their return springs. Attachment of the shields 7 is then completed when the cylinder head 2 is tightened onto the engine block surrounding the sleeves 1, as the edges of the shield 7 bear on the relatively elastic cylinder head gasket which allows movements of these shield edges under the effect of the variations in temperature of the shield 7 and the differential expansions between the sleeve 1, the cylinder head joint 9 and the heat shield 7.

Obviously, numerous modifications and variations of the present invention are possible in light of the above teachings. It is therefore to be understood that within the scope of the appended claims, the invention may be practiced otherwise than as specifically described therein.

What is claimed as new and desired to be secured by Letters Patent of the United States is:

1. In a cylinder head of a combustion engine having at least one bore for a valve seat insert, a first surface defining a portion of a combustion chamber, and a valve seat insert including an annular peripheral rim, one said insert being fixed in each said bore, a heat shield comprising:

a flat plate formed of a heat insulating material, said plate including an aperture for each said valve seat insert, said plate being positioned on said first surface and having a first portion held between said first surface and each said rim, wherein said cylindrical head is connected to an engine cylinder via an elastic gasket, wherein an edge portion of said heat shield is elastically held between said gasket and said first surface, and wherein said first portion of said heat shield is fixed to said cylinder head solely by said insert being fixed in said bore.

2. The heat shield of claim 1 wherein said first portion is the peripheral edge of each of said aperture.

3. The heat shield of claim 2 wherein a surface of said rim holding said peripheral edge, and said peripheral edge, both define mating conical surfaces.

* * * * *